US005690587A

United States Patent [19]

Gruenangerl

[11] Patent Number: 5,690,587

[45] Date of Patent: Nov. 25, 1997

[54] TREADMILL WITH CUSHIONED SURFACE, AUTOMATIC SPEED CONTROL AND INTERFACE TO EXTERNAL DEVICES

[76] Inventor: Johann Gruenangerl, A-5421 Adnet, Austria

[21] Appl. No.: 607,761

[22] Filed: Feb. 27, 1996

[30] Foreign Application Priority Data

Apr. 21, 1993 [AT] Austria ..... 780/93

[51] Int. Cl.[6] ..... A63B 22/02

[52] U.S. Cl. ..... 482/54

[58] Field of Search ..... 482/54

[56] References Cited

U.S. PATENT DOCUMENTS

| | | | |
|---|---|---|---|
| 3,703,284 | 11/1972 | Hesen | 482/54 |
| 4,227,487 | 10/1980 | Davis | 482/54 |
| 4,616,882 | 10/1986 | Truslaske et al. | 482/54 |

*Primary Examiner*—Lynne A. Reichard
*Attorney, Agent, or Firm*—Herbert L. Lerner; Laurence A. Greenberg; Werner H. Stemer

[57] ABSTRACT

A treadmill includes a running deck in a running area and rollers. An endless transportation belt is stretched over and guided around the rollers for moving the transportation belt in a certain direction in the running area. A cushioning layer is disposed on the running deck and a glide layer with segments covers the cushioning layer. Both of these layers are underneath the transportation belt. Another embodiment of the invention is a treadmill including rollers and an endless transportation belt stretched over and guided around the rollers. A control unit is connected to a belt drive which drives the rollers for controlling the speed of the transportation belt. A position sensor is disposed in the vicinity of the transportation belt to recognize the position of a person on the transportation belt. The position sensor is also connected to the control unit which automatically adjusts the speed of the transportation belt by sending a position signal to the control unit. An additional embodiment of the invention is a configuration for conducting a treadmill race. A further embodiment of the invention is a configuration for displaying a virtual reality in combination with a treadmill.

6 Claims, 5 Drawing Sheets

TREADMILL WITH CUSHIONED SURFACE, AUTOMATIC SPEED CONTROL AND INTERFACE TO EXTERNAL DEVICES

BACKGROUND OF THE INVENTION

1. Field of the Invention

The invention relates to a treadmill including a running deck defining a running area, rollers, and an endless transportation belt being stretched over and guided around the rollers for movement in a given direction in the running area.

2. Description of the Related Art

German Published, Prosecuted Application DE-B 21 63 289 discloses a treadmill for diagnostics and therapeutic uses, whereby an endless belt runs around two rollers, mounted on the edges of a long, rectangular support frame. The belt moves at variable speeds in the opposite direction of the walking direction and glides above a metal plate, which is covered by a low friction material and is mounted on a platform, fixed to the frame.

German Published, Prosecuted Application DE-B 21 63 289 was intended to create a flat walking surface as opposed to the prior art such as U.S. Pat. No. 1,766,089, which included rollers transverse to the walking direction as support for the transportation belt. Such a configuration has the advantage that only a small portion of the belt is impacted by the foot of the person on the treadmill. However, the impact may be either on top of a roller or in between two rollers placed next to one another. Therefore, movement of the foot on the transportation belt is uncomfortable.

The flat walking area as described in German Published, Prosecuted Application DE-B 21 63 289, therefore, has some value over the roller configuration. The described metal plate distributes the weight of a person across a wide area of the transportation belt and by installing a damping layer of felt may result in a cushioning effect comparable to a carpet, but yet not as soft as desirable.

SUMMARY OF THE INVENTION

It is accordingly an object of the invention to provide a treadmill with cushioned surface, automatic speed control and interface to external devices, which overcomes the above-mentioned disadvantages of the heretofore-known devices and methods of this general type and which creates a running area with properties comparable to soft forest ground, has automatic speed control, and an interface to external devices.

With the foregoing and other objects in view there is provided, in accordance with the invention, a treadmill, comprising a running deck defining a running area; rollers; an endless transportation belt being stretched over and guided around the rollers for movement in a given direction in the running area; a cushioning layer disposed on the running deck; and a glide layer having segments covering the cushioning layer, the glide layer being disposed underneath the transportation belt.

By the segmentation of the gliding layer directly underneath the transportation belt, the belt impacts the gliding layer and the cushioning material only in a limited area. As a result, a physiologically optimized cushioning, ideally protecting the joints of the person walking on the belt is created, simulating the effects of a soft forest surface.

The invention of the instant application is not only suitable for motor driven transportation belts and transportation belts powered by the person walking on the belt where the position of the person on the transportation belt remains fixed, but is also suitable where the position of the person on the transportation belt varies and the walking speed of the person is added to the transportation speed of the belt. For example, such a transportation belt is commonly used in airports.

The gliding layer need not be segmented across the entire running area, since the person on the transportation belt usually only moves on the center third of the belt. Also, segmenting the edges of the gliding layer is of minor impact.

In accordance with an added feature of the invention, the treadmill includes springs, the segments being metal strips disposed parallel to the given direction, and the springs securing the rectangular segments to the running deck.

The segmented gliding layer may include steel segments which are loosely laid on top of the cushioning layer and are held under tension with springs. One advantage of using metals is the fact that friction heat between the belt and the gliding layer may be removed effectively. Good results have also been achieved by using rectangular plastic segments, which are secured to the cushioning layer in a sandwich construction. Sandwich construction has the advantage of being very simple and cost effective.

In accordance with an additional feature of the invention, the segments are plastic strips disposed parallel to the given direction and adhesively connected to the cushioning layer.

In accordance with another feature of the invention, the glide layer is a first glide layer, and including a second glide layer adjacent the first glide layer, the segments of the first guide layer being plastic and adhesively connected to the cushioning layer.

In accordance with a further feature of the invention, the second glide layer is adhesively connected to the segments of the first glide layer.

In accordance with again an added feature of the invention, the segments of the first glide layer are square.

In accordance with again an additional feature of the invention, there is provided a treadmill, comprising rollers; an endless transportation belt being stretched over and guided around the rollers; a belt drive connected to the rollers for driving the rollers; a control unit connected to the belt drive for controlling the speed of the transportation belt; and a position sensor in the vicinity of the transportation belt for recognizing a position of a person on the transportation belt, the position sensor being connected to the control unit for automatically adjusting the speed of the transportation belt by sending a position signal to the control unit.

In accordance with again another feature of the invention, the treadmill includes a rope around the person on the transportation belt, the position sensor being a potentiometer connected to the rope.

In accordance with again a further feature of the invention, the position sensor emits infrared light for measuring the position of the person on the transportation belt.

In accordance with yet an added feature of the invention, the position sensor emits ultrasonic waves for measuring the position of the person on the transportation belt.

In accordance with yet an additional feature of the invention, the position sensor emits a laser beam for measuring the position of the person on the transportation belt.

In accordance with yet another feature of the invention, there is provided a configuration for conducting a treadmill race, comprising an array of treadmills, each of the treadmills including: rollers; an endless transportation belt being stretched over and guided around the rollers; a belt drive connected to the rollers for driving the rollers; a control unit connected to the belt drive for controlling the speed of the transportation belt; and a position sensor in the vicinity of the transportation belt for recognizing a position of a person on the transportation belt, the position sensor being connected to the control unit for automatically adjusting the speed of the transportation belt by sending a position signal to the control unit; an external device; and a bidirectional data interface connecting the treadmills to the external device for conducting a race with a synchronous start and for displaying and ranking data sent by the treadmills to the external device.

In accordance with yet a further feature of the invention, there is provided a configuration for displaying virtual reality in combination with a treadmill, comprising a treadmill having rollers; an endless transportation belt being stretched over and guided around the rollers; a belt drive connected to the rollers for driving the rollers; a control unit connected to the belt drive for controlling the speed of the transportation belt; and a position sensor in the vicinity of the transportation belt for recognizing a position of a person on the transportation belt, the position sensor being connected to the control unit for automatically adjusting the speed of the transportation belt by sending a position signal to the control unit; an external device; a display system connected to the external device; and a bidirectional data interface connecting the treadmill with the external device for displaying a virtual reality on the display system.

Other features which are considered as characteristic for the invention are set forth in the appended claims. Although the invention is illustrated and described herein as embodied in a treadmill with cushioned surface, automatic speed control and interface to external devices, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
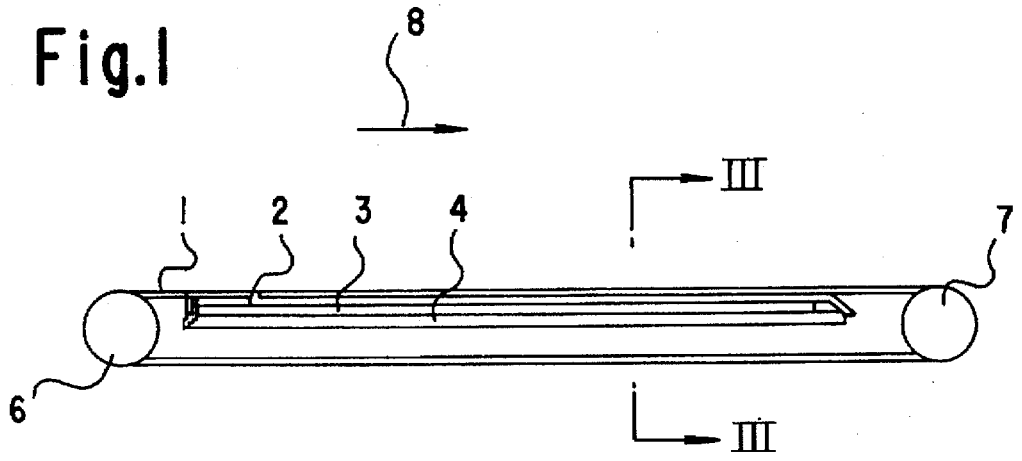
FIG. 1 is a diagramatic, side-elevational view of a treadmill according to the invention.
Figure 3:
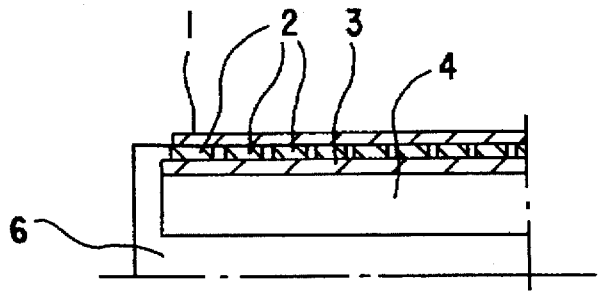
FIG. 3 is a cross-sectional view of the treadmill according to the invention, which is taken along the line III—III of FIG. 1 in the direction of the arrows.
Figure 2:
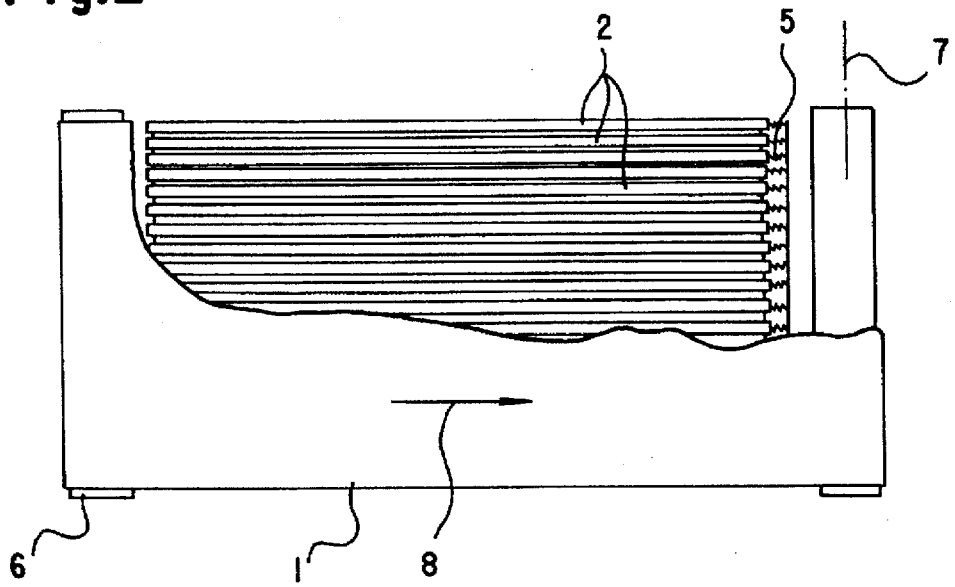
FIG. 2 is a top-plan partly cut-away view of the treadmill according to the invention.

Referring now to the figures of the drawing in detail and first, particularly, to FIGS. 1, 2, and 3 thereof, there is seen a treadmill according to the invention having an optimized cushion with physical properties to allow the foot, while stepping on the surface of a transportation belt 1, to penetrate a cushioning layer 3. In addition, a running deck 4 is solidly linked to a treadmill understructure, thus eliminating resonance vibrations which in turn reduces impact of unwanted and uncontrolled forces to the joints.

The endless transportation belt 1 is driven in the direction indicated by an arrow 8 and is guided around and stretched over rollers 6, 7 which are mounted on a non-illustrated sturdy frame structure. The rollers 6, 7 are also mounted on the non-illustrated sturdy frame structure. The transportation belt also glides over the running deck 4. The optimized cushioning is achieved by installing the cushioning layer 3 which is made of a suitable material having the desired cushioning properties, i.e. foamed plastics, rubber, cork, etc.. The cushioning layer 3 is placed underneath the transportation belt 1 and on top of the running deck 4 in the running area. The running deck 4 is solidly fastened to the treadmill understructure. To enhance the gliding properties of the transportation belt 1, a gliding layer 2 is placed on top of the cushioning layer 3. The gliding layer 2 is constructed of appropriate thin materials or compound materials with appropriate high wear resistance and low friction coefficients or a combination of such materials. Example materials are steel, PTFE-films, plastic (Pertinax/plastic coated paper), fiber reinforced plastic compounds, various other suitable plastic materials, etc. Depending on the desired cushioning effect of the treadmill, the gliding layer 2 may be constructed in various ways, in which the connection between the combined materials (loose, sandwich, etc.) is of no importance. Various possibilities for the construction of the gliding layer 2 include:

1. a continuous PTFE film stretched over the cushioning layer 3;
2. rectangular steel or plastic segments disposed parallel to the direction of movement;
3. rectangular segments disposed parallel to the direction of movement and covered by a continuous PTFE film;
4. any kind of geometrical form of segments constructed of any material and covered by a continuous PTFE film.

Figure 2A:
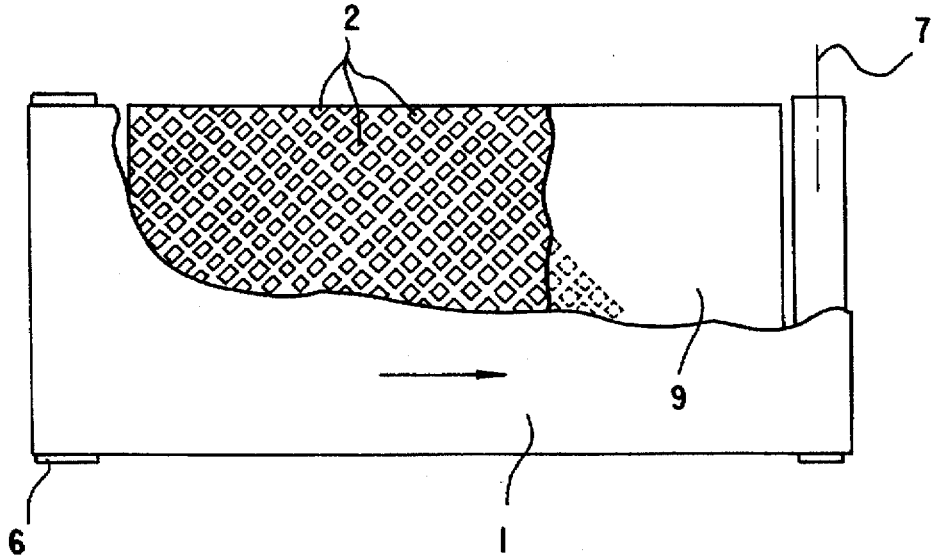
FIG. 2A is a top-plan partly cut-away view of another embodiment of the treadmill according to the invention.

The gliding layer segments may be asymmetrical in the transportation direction, diagonal in various angles to the transportation direction or transverse to the running area and the transportation direction. The gliding layer may also be segmented in any kind of geometric pattern with any shape or size of segments. The invention is not limited to the rectangular segments disposed parallel to the direction of movement. If the segments of the segmented gliding layer 2 are disposed asymmetrically, an additional gliding layer 9 as shown in FIGS. 3 and 2A is applied above the segmented gliding layer 2. The additional gliding layer 9 may be made of any of the materials listed for the segmented gliding layer 2. The additional gliding layer 9 may be placed loosely on top of the cushioning material and the segmented gliding layer 2 or the additional gliding layer 9 may be included in the sandwich construction.

As shown in FIG. 2, the segmented gliding layer is secured to the running deck 4 with springs 5.

The material for the running deck 4 may be selected from wood, aluminum sandwich or profiles or plastic materials, depending on strength requirements.

The cushioning layer 3 may be constructed from cork, felt, rubber, foamed plastics (i.e. PVC, PU like Getzner Silomer P12).

Figure 4:
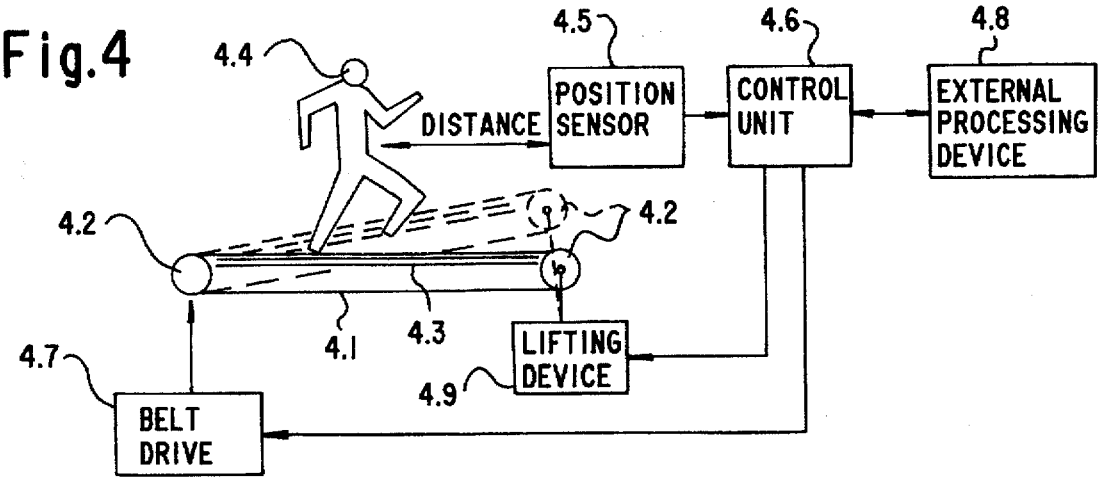
FIG. 4 is a diagrammatic, side-elevational view of the treadmill along with a block circuit diagram for controlling the speed of the treadmill.

The mechanical structure of a treadmill with physiologically optimized cushioning, automatic speed/position control and interface to an external control or input/output device is shown in FIG. 4. A continuous running surface in the form of an endless transportation belt 4.1 is guided around and held under tension by rollers 4.2 and glides across a running deck 4.3 in the actual running area. The running deck 4.3 may be constructed with special cushioning to achieve optimum running comfort. The position of the person 4.4 on the belt is detected with a position sensor 4.5, which may be either a potentiometric device with a mechanically linked cable, an infrared/visible light or ultrasonic or a laser controlled unit. The detected position information (either analog or digital) is fed to a control unit 4.6 for further processing. The control unit 4.6 calculates a speed setpoint for the belt drive 4.7, which is derived from the position signal, generated by the position sensor 4.5 and a manual speed profile input of the user. Known off-the-shelf components (i.e. DC drive, AC motor with servo control, etc.) may be used for the belt drive 4.7. The belt drive 4.7 may also include an underlayed speed control with integral measurement of actual speed values. The motor of the belt drive 4.7 activates one of the two rollers 4.2. Furthermore, the control unit 4.6 calculates from the measured values all pertinent values to be displayed on the user panel. An external processing device 4.8 is linked to the control unit 4.6 by means of a bidirectional data interface like RS-232, RS-422/485, CAN-bus, Ethernet, etc. The external processing device 4.8 may transfer setpoints to the control unit 4.6 such as EKG, Ergospyrometry, analysis systems, etc. The control unit 4.6 may transfer any measured or recalculated data and other information (i.e. time, distance, speed, slope, heart rate, etc.) to the external processing device 4.8 where the data may be stored, processed or documented in the external processing device 4.8 (i.e. running competitions, visual and aural animation/virtual reality, computer supported analysis of test series, etc.). In addition, there may also be a lifting device 4.9 suitable to lift the front end of the running deck 4.3 when simulating a slope or incline of the running deck 4.3. The control unit 4.6 controls the lifting device 4.9.

The basic construction of a treadmill with automatic speed control has been explained above and is shown in FIG. 4. All functions for signal conditioning, recalculations and processing have been implemented as software in the control unit 4.6.

If a person using the treadmill runs faster than the transport belt 4.1, the person will move forward on the treadmill. If the person is running slower, then the person will move backward on the treadmill. These two situations are the basis on which treadmills can be automatically controlled with respect to speed. The position of the person on the transport belt 4.1 may be determined by the position sensor 4.5 shown in FIG. 4. The position sensor 4.5 transfers a position signal proportional to the distance between the position sensor 4.5 and the person and may be available in either digital or analog form, which is converted to speed setpoints by special control algorithms in the software of the control unit 4.6 which in turn adapts the transportation belt 4.1 speed to the running speed of the person.

Figure 5:
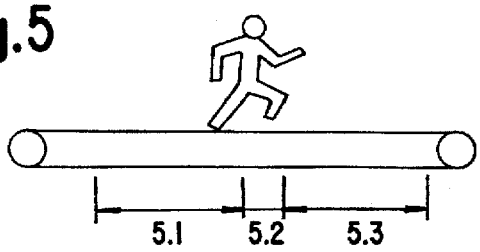
FIG. 5 is a side-elevational view of the treadmill according to the invention.

The running area on the transportation belt is divided into four areas as shown in FIG. 5. If a person is in a stalling area 5.1, the transportation belt speed will be lowered according to a special control algorithm. If a person is in a constant area 5.2, the transportation belt speed will be held constant. If a person is in an acceleration area 5.3, the transportation belt speed will be increased according to a special control algorithm. The area behind the stalling area 5.1 is utilized to allow a quick safety stop of the transportation belt if a person is detected in that area. This safety feature does not influence the automatic speed function and is, therefore, optional.

Figure 6:
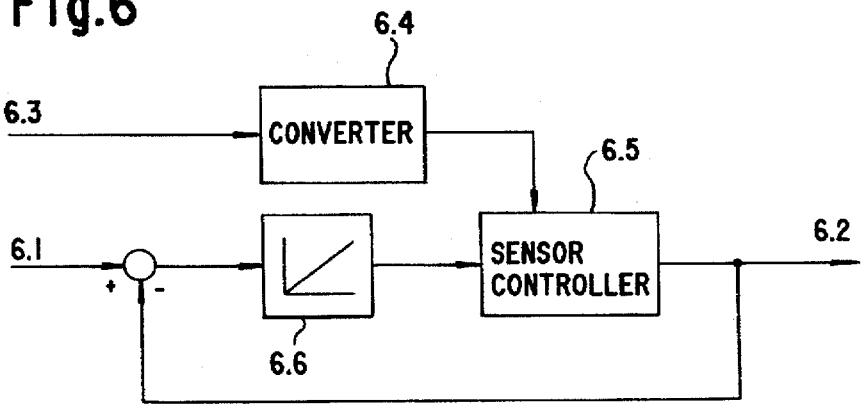
FIG. 6 is a block circuit diagram of speed control structure of a preferred embodiment of the treadmill according to the invention.

As shown in FIG. 6, an input signal 6.1 of the control unit equals the speed setpoint and is derived from a selected operating mode or running program. The speed setpoint 6.1 is added to the actual (measured) speed and compared to an actual speed value 6.2, which is output from the control unit. If deviations are detected (i.e. through a programmed speed change), the speed is adapted by using a variable ramp function 6.6. The distance proportional signal 6.3 from the position sensor (4.5 in FIG. 4) is converted to a digital signal (if the position sensor output is analog), smoothed and standardized in the converter 6.4 before the signal is sent to a sensor controller 6.5. The signal is processed in the sensor controller 6.5 by detecting for a particular range and by an appropriate control algorithm, resulting in the control output 6.2.

Figure 7:
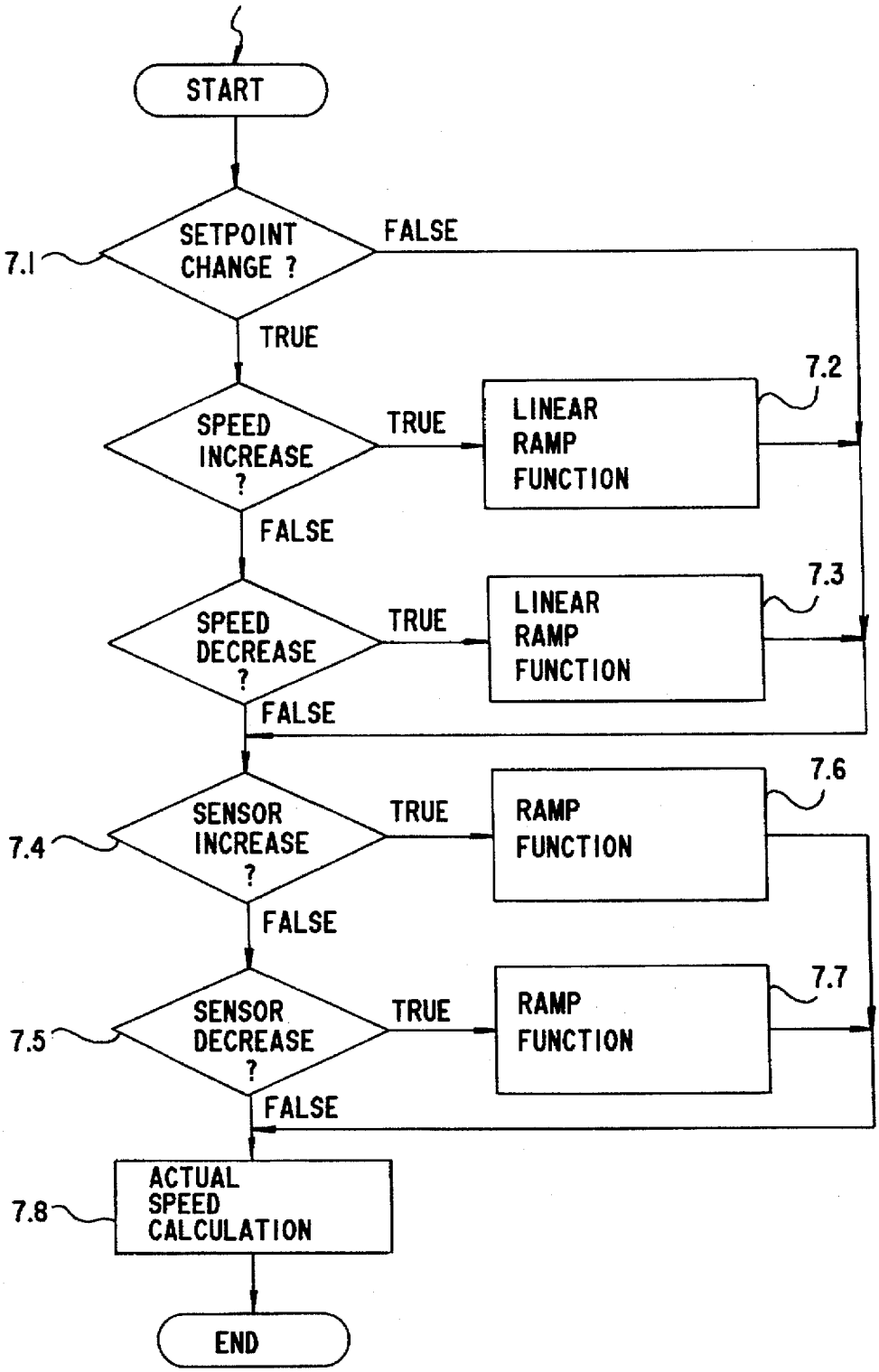
FIG. 7 is a flow diagram of a speed control algorithm of a preferred embodiment of the treadmill according to the invention.

The process of the control unit is depicted in FIG. 7. The control algorithm is activated once every 100 milliseconds. A setpoint change question box 7.1 is TRUE whenever the speed setpoint has been changed (i.e. by manual input or derived from a program change). The transportation belt speed is changed by using a linear ramp function (7.2, 7.3).

A sensor increase question box 7.4 is TRUE if a person is in the acceleration area and speed control is enabled by a program or manual input of the proper operations mode. Actual speed is then increased by using any kind of ramp function 7.6 (i.e. linear, sinusoidal, quadratic, etc.).

A sensor decrease question box 7.5 is TRUE if a person is in the stalling area and speed control is enabled by a program or manual input of the proper operations mode. Actual speed is then decreased by using any kind of ramp function 7.7 (i.e. linear, sinusoidal, quadratic, etc.). The speed decrease in ramp function 6.7 may result in the transportation belt being stopped (speed=0).

A box 7.8 calculates actual speed, distance within the last control iteration and output of the new speed to the belt drive driving the transportation belt.

Interfacing the treadmill as described with respect to FIG. 4 with an external device 4.8 allows a wide range of completely new applications. For many of such uses, the position sensor of the automatic speed/position control shown in FIGS. 4–7 is a prerequisite. Current applications are limited to the reception of commands from the external device, i.e. EKG and Ergospyrometry apparatus. In this case, the data link is bidirectional, so the treadmill may also control the external device. The following applications are typical, but the invention is not limited to the described uses.

Figure 8:
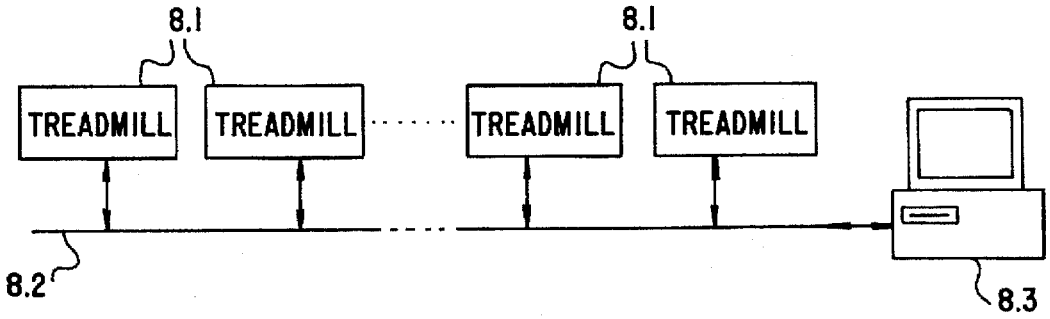
FIG. 8 is a block circuit diagram of multiple, networked treadmills configured for a running competition according to the invention.

As shown in FIG. 8, multiple treadmills 8.1 may be linked together and to an external computer 8.3 (i.e. personal computer) by means of any kind of network 8.2, to conduct a running competition. The external computer 8.3 uploads the selected program or competition pattern to all connected units and starts the run on all treadmills 8.1 simultaneously. During the competition the computer polls data (i.e. speed, distance) and processes the data for display and scoring purposes. In order to conduct such competitions, the automatic speed/position control shown in FIGS. 4–7 is necessary.

Figure 9:
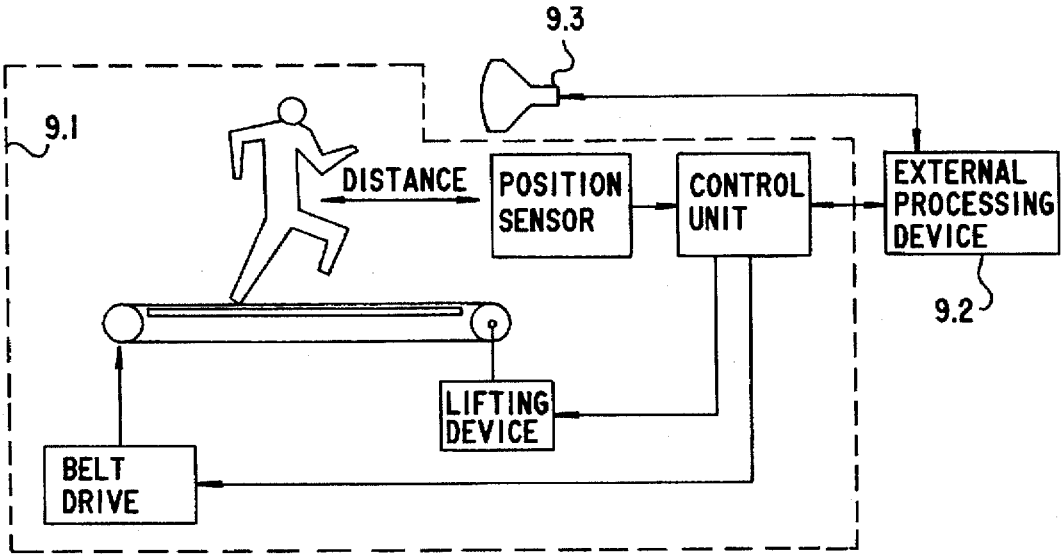
FIG. 9 is a block circuit diagram of a treadmill configured for animation and virtual reality according to the invention.

As shown in FIG. 9, another application of the invention is a treadmill 9.1 with animation and virtual reality capabilities. An external device 9.2 in this case has a commonly known electronic image generator 9.3. The electronic image generator receives necessary data from the treadmill (i.e. position of the person on the belt, speed, distance). The treadmill data is processed and used to control the real time display of visual images, according to the actual transportation belt speed. If the environment displayed includes slopes, such slope information can be sent to the control unit of the treadmill for changing the actual slope of the treadmill with the lifting device to increase the accuracy of the displayed picture.

Output of the images is performed on big screen monitors or TV sets, or projection screens displaying single or multiple channels. Virtual reality headgear may also be used, which in turn can transfer head position data for correct tracking in the viewing direction. The automatic speed/position control shown in FIGS. 4–7 is necessary to accurately calculate the eye position of the person on the transportation belt in order to allow for real time display of the generated visual cues.

I claim:

1. A treadmill, comprising:

a running deck defining a running area;

rollers;

an endless transportation belt being stretched over and guided around said rollers for movement in a given direction in said running area;

a cushioning layer disposed on said running deck; and a glide layer disposed between said cushioning layer and said transportation belt, said glide layer being formed of a plurality of individual, mutually parallel strips glued to said cushioning layer.

2. The treadmill according to claim 1, including springs connected between said strips and said running deck,, said strips being metal strips disposed parallel to the given direction.

3. The treadmill according to claim 1, wherein said strips are plastic strips disposed parallel to the given direction.

4. The treadmill according to claim 1, wherein said glide layer is a first glide layer, and including a second glide layer adjacent said first glide layer, said strips of said first guide layer being plastic and adhesively connected to said cushioning layer.

5. The treadmill according to claim 4, wherein said second glide layer is adhesively connected to said strips of said first glide layer.

6. The treadmill according to claim 4, wherein said strips of said first glide layer are square.

* * * * *